US005388891A

United States Patent [19]

Oka et al.

[11] Patent Number: 5,388,891

[45] Date of Patent: Feb. 14, 1995

[54] CUSHION STRUCTURE OF AUTOMOTIVE SEAT

[75] Inventors: Takashi Oka, Tokyo; Yoshiharu Ishikawa, Kanagawa, both of Japan

[73] Assignees: Nissan Motor Co., Ltd., Yokohama; Ikeda Bussan Co., Ltd., Kanagawa, both of Japan

[21] Appl. No.: 941,293

[22] Filed: Sep. 4, 1992

[30] Foreign Application Priority Data

Sep. 9, 1991 [JP] Japan ..... 3-257078
Sep. 9, 1991 [JP] Japan ..... 3-257079

[51] Int. Cl.[6] ..... A47C 15/00

[52] U.S. Cl. ..... 297/452.48; 297/452.27; 297/452.60; 428/6; 5/481

[58] Field of Search ..... 297/452.48, 452.61, 297/DIG. 1, 452.60; 5/481, 474, 448, 468, 653, 645, 643, 502; 428/6

[56] References Cited

U.S. PATENT DOCUMENTS

| | | | |
|---|---|---|---|
| 276,650 | 5/1883 | Weigell | 5/448 |
| 2,703,603 | 3/1955 | Endicott | 297/452.48 |
| 3,335,435 | 8/1967 | Marsh et al. | 5/481 |
| 3,740,770 | 6/1973 | Powell | 297/452.48 |
| 4,405,681 | 9/1983 | McEvoy | 5/481 X |
| 4,469,739 | 9/1984 | Gretzinger et al. | 428/198 |
| 4,726,086 | 2/1988 | McEvoy | 5/481 X |
| 4,738,999 | 4/1988 | Blenner et al. | 524/80 |
| 4,747,638 | 5/1988 | Saito | 297/452.61 |
| 4,776,048 | 10/1988 | Wilheim | 5/448 X |
| 4,840,430 | 6/1989 | Shimada | 297/452.61 |
| 4,930,173 | 6/1990 | Woller | 5/481 |

FOREIGN PATENT DOCUMENTS

| | | | |
|---|---|---|---|
| 1685161 | 8/1971 | Germany | 5/448 |
| 38-27880 | 12/1963 | Japan . | |
| 43-16679 | 7/1968 | Japan . | |
| 56-30319 | 7/1981 | Japan . | |
| 146649 | 7/1986 | Japan | 297/284.1 |
| 2-17335 | 4/1990 | Japan . | |
| 2-33495 | 7/1990 | Japan . | |
| 2-47914 | 12/1990 | Japan . | |
| 9013244 | 11/1990 | WIPO | 5/448 |

*Primary Examiner*—Peter M. Cuomo
*Assistant Examiner*—Jerry Redman
*Attorney, Agent, or Firm*—Lowe, Price, LeBlanc & Becker

[57] ABSTRACT

A cushion structure of seat has a major holding part constructed of foamed polyurethane. A wadding is applied to a front surface of the major holding part. The wadding is constructed of down and feather which are bound with a binder. The major holding part and the wadding which are thus united are put in a bag-shaped outer skin.

13 Claims, 6 Drawing Sheets

A'
B'
C'
D'
LOAD (Kg)
DEFLECTION (mm)

A"

B"

C"

D"
DEFLECTION (mm)
LOAD (kg)

CUSHION STRUCTURE OF AUTOMOTIVE SEAT

BACKGROUND OF THE INVENTION

1. Field of the Invention

The present invention relates in general to seats for motor vehicles, and more particularly to automotive seats of a type which comprises a seat-base portion and a seat-back portion. More specifically, the present invention is concerned with a cushion structure of such seats.

2. Description of the Prior Art

Hitherto, various automotive seats of the above-mentioned type have been proposed and put into practically use. Some are shown in Japanese Utility Model Second Provisional Publications Nos. 38-27880, 43-16679, 56-30319 and 2-47914.

The 38-27880 publication shows a cushion structure which uses, as a cushion pad, a layered wadding of feather bound with adhesive. While, the 43-16679, 56-30319 and 2-47914 publications respectively show cushion structures which use, as an outer cover, felt, palm lock and layered polyurethane foam.

However, hitherto, due to their inherent constructions, the conventional seats having the above-mentioned cushion structures have failed to provide the seat occupants with satisfyingly comfortable sitting feeling. In fact, some of the conventional cushion structures are constructed to cause the seat occupant to be sweaty, some of them are easily subjected to a marked permanent set and some of them fail to provide the seat with a sophisticated external appearance.

SUMMARY OF THE INVENTION

It is therefore an object of the present invention to provide a cushion structure of an automotive seat, which is free of the above-mentioned drawbacks.

According to a first aspect of the present invention, there is provided a cushion structure of seat, which comprises a major holding part constructed of flexible foamed material; a wadding constructed of down and feather which are bound with a binder, the wadding being applied to a front surface of the major holding part; and an outer skin for covering the major holding part and the wadding.

According to a second aspect of the present invention, there is provided a cushion structure of a seat-base portion of an automotive seat, which structure comprises a major holder part constructed of foamed polyurethane, the major part having a recess at a front side thereof; a center holder part constructed of a wadding of down and feather which are bound with a binder, the center holder part being received in the recess of the major holder part, the wadding including approximately 90 wt. % down and approximately 10 wt. % feather; a portion where part of the polyurethane foam of the major holding part penetrates the wadding of the center holder part to provide a tight bonding therebetween; and a bag-shaped outer skin for putting therein the major holding part and the center holding part.

According to a third aspect of the present invention, there is provided a cushion structure of a seat-back portion of an automotive seat, which structure comprises a major holder part constructed of foamed polyurethane; a front cover constructed of a wadding of down and feather which are bound with a binder, the front cover entirely covering a front surface of the major holding part and including approximately 90 wt. % down and approximately 10 wt. % feather; stitched portions of the front cover by which the front cover is partitioned into three portions; and a bag-shaped outer skin for putting therein the major holding part and the front cover.

DETAILED DESCRIPTION OF THE INVENTION

Figure 1:
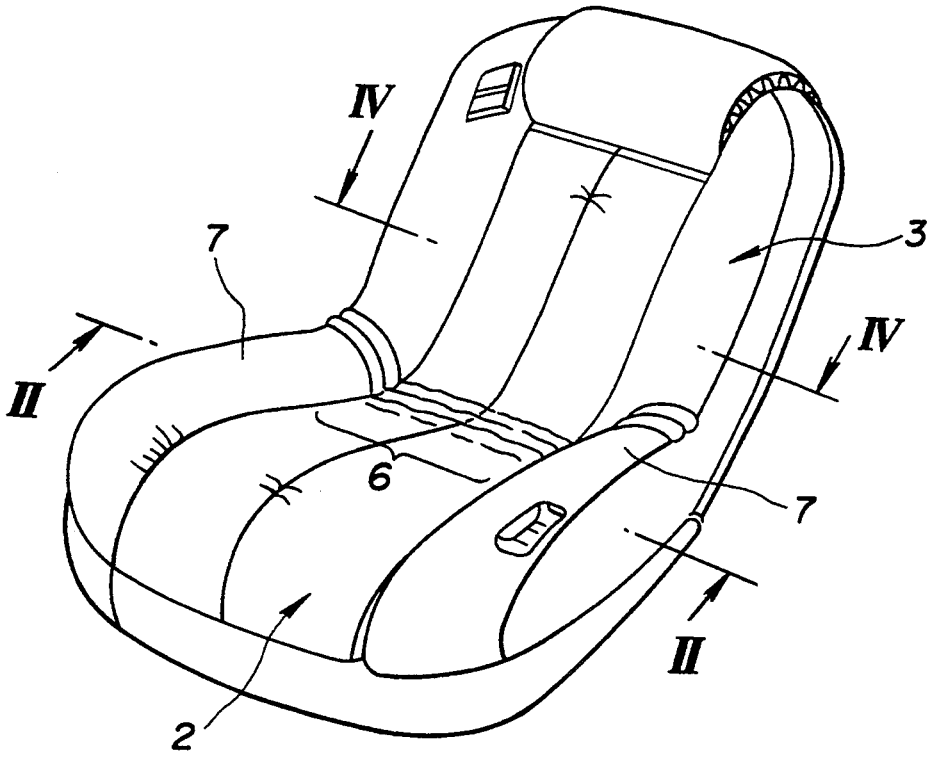
FIG. 1 is a perspective view of an automotive seat to which a cushion structure of a first embodiment of the present invention is practically applied.
Figure 2:
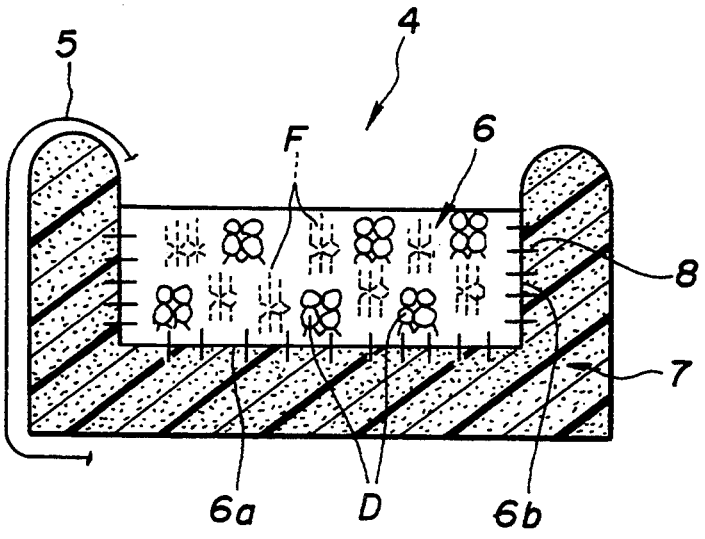
FIG. 2 is a schematically illustrated sectional view taken along the line II—II of FIG. 1.
Figures 3A, 3B, 3C, 3D:
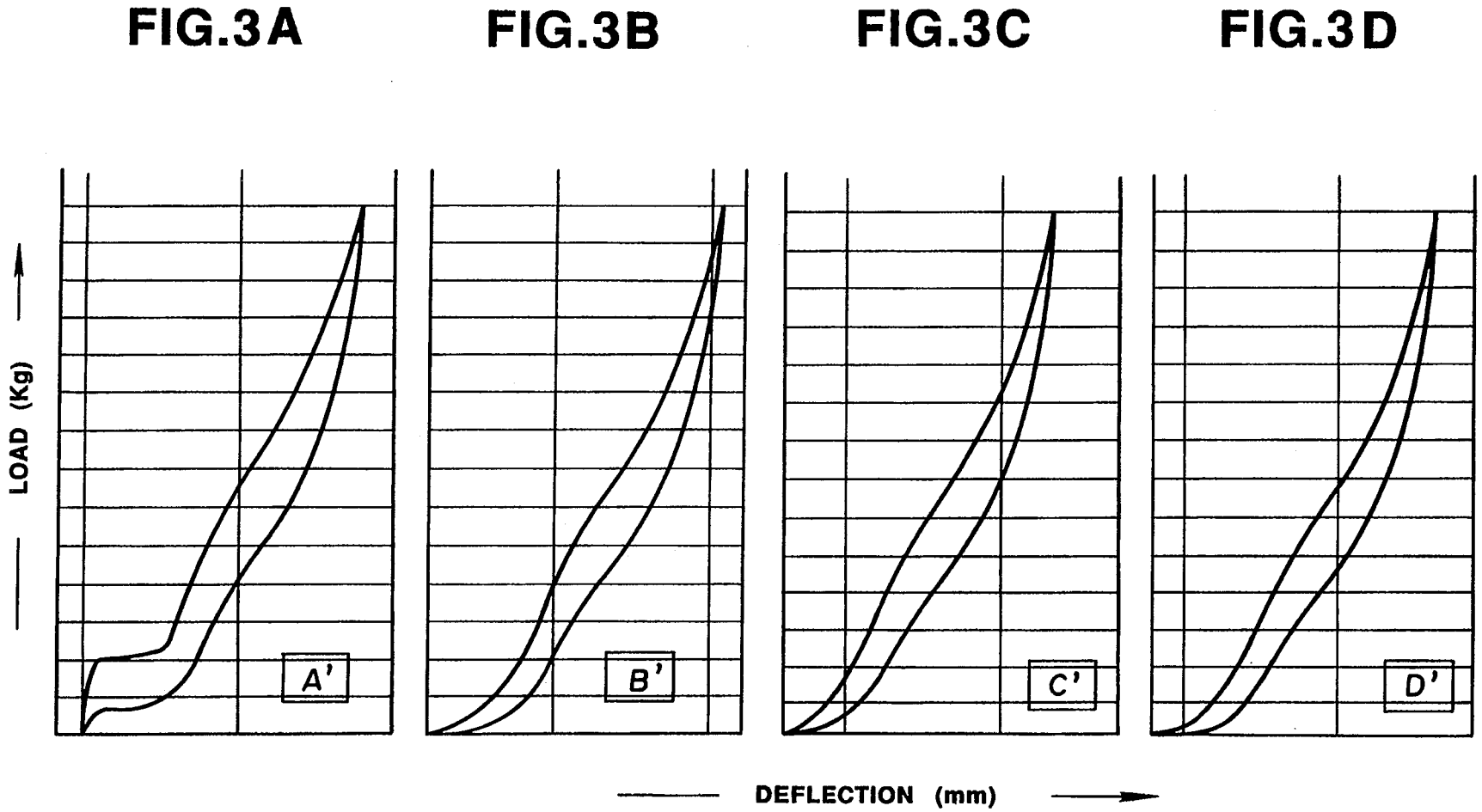
FIGS. 3A, 3B, 3C and 3D are graphs showing the "Load-Deflection" characteristic of four types of materials for the cushion structure of the first embodiment.

Referring to FIGS. 1 and 2 of the accompanying drawings, there is shown an automotive seat 1 to which the present invention is practically applied.

The seat 1 comprises generally a seat-base portion 2 and a seat-back portion 3. A cushion structure 4 of a first embodiment constitutes the seat-base portion 2.

As is seen from FIG. 2, the cushion structure 4 comprises generally a major holder part 7 constructed of foamed polyurethane, a center holder part 6 constructed of wadding of bound down and feather, and a bag-shaped outer skin 5 constructed of an artificial leather or the like.

As shown, the major holder part 7 is constructed to surround the bottom and side surfaces, respectively **6*a* and 6*b*, of the center holder part 6. Designated by numeral 8 is the area where part of the foamed polyurethane penetrates into the wadding of bound down and feather to provide a tight bonding therebetween. The wadding of the center holder part 6** herein disclosed comprises about 90 wt % down "D" and about 10 wt % feather "F".

The process of producing the cushion structure 4 is as follows.

First, a wad including about 90 wt % down and about 10 wt % feather is prepared, and uncured and thus liquefied material of polyurethane elastomer as a binder is sprayed upon the wad while stirring the wad. The wad is then put into a case and led into an oven to cure the binder. With this, a resiliently deformable shaped wadding of the bound down and feather is produced. Then, the shaped wadding is placed in a molding die and a liquid material for foamed polyurethane is poured into the molding die. During this material pouring, part of the liquid urethane material penetrates into the shaped wadding. Then, the molding die is led into an oven to cure the polyurethane foam. With this, a cushion pad including the major holding part 7 of polyurethane foam and the center holder part 6 of the shaped wadding is produced. Because of the penetration of liquid urethane material into the wadding, the cushion pad thus produced has the above-mentioned area 8. Then, the cushion pad is put into the bag-shaped outer skin 5 to produce the cushion structure 4.

In order to find out the optimal mixing ratio of down and feather, four types of center holder parts 6 were produced changing the mixing ratio of them. Various test pieces were cut out from these center holder parts 6 and subjected to several performance tests.

The four types of center holder parts 6 produced are as follows:

A-type: a center holder part constructed of only flexible foamed polyurethane,

B-type: a center holder part constructed of 30 wt. % down and 70 wt % feather,

C-type: a center holder part constructed of 50 wt. % down and 50 wt % feather, and D-type: a center holder part constructed of 90 wt. % down and 10 wt % feather.

Test pieces produced from these four types of center holder parts were subjected to the following performance tests.

(1) Moisture absorption test

Test pieces of 100×100×20 (mm) in size were cut out from the four types of center holder parts. Each test piece was 700 g in weight per one square meter ($m^2$). These test pieces were left in an atmosphere of temperature of 50° C. and humidity of 90% for 3 to 120 minutes. The coefficient of moisture absorption was calculated from the following equation. It is to be noted that "S" designates each test piece.

$$M=[(M1-M0)\times 100 \quad (1)$$

wherein:

M: coefficient (%) of moisture absorption of "S",

M1: weight of "S" after test,

M0: weight of "S" before test.

The results of the test are shown in the attached TABLE-1. As is seen from this table, the B, C and D-types of center holder part showed higher moisture absorption effect (viz., hygroscopicity) than the A-type. This means that the center holder part 6 can quickly absorb the sweat of the seat occupant thereby providing him or her with a comfortable sitting feeling.

(2) Moisture evaporation test

Test pieces of 100×100×20 (mm) in size were deaerated in water and left in water for two hours. Then, these test pieces were pressed twice by a press roller of 2 Kg. Then, the test pieces were put into an oven of 50° C. for 20 to 150 minutes. The coefficient of moisture evaporation was calculated from the following equation.

$$R=[[(N1-N0)-(N2-N0)]/(N1-N0)]\times 100 \quad (2)$$

wherein:

R: coefficient ( % ) of moisture evaporation of "S",

N1: weight of "S" just after roller pressing,

N0: weight of "S" before water submersion, and

N2: weight of "S" just after removal from oven.

The results of the test are shown in the attached TABLE-2. As is seen from this table, the B, C and D-types of center holder part showed higher moisture evaporation effect than the A-type. This means that the center holder part 6 can quickly evaporate the absorbed moisture thereby providing the seat occupant with a comfortable sitting feeling.

(3) Heat accumulation test

Test pieces of 100×100×20 (mm) in size were left in an atmosphere of a temperature of 100° C. for 2 hours. After this, temperatures of a center portion and an outer wall portion of each test piece were measured. The results of this test are shown in the attached TABLE-3. As is seen from this table, the B, C and D-types of center holder part showed higher heat accumulation effect than the A-type. This means that the center holder part 6 has a desirable heat retaining property.

(4) Restoring test

Test pieces of 50×50×20 (mm) in size were cut out from the four types of center holder parts. These test pieces were grouped into two. The test pieces of one group were held in a presser while being compressed by 50% and left in a dried air at a temperature of 70° C. for 22 hours. The test pieces of the other group were held in another presser while being compressed by 50% and left in an atmosphere of temperature of 50° C. and humidity of 95% for 22 hours. After the test, the permanent set of each test piece was measured. The coefficient of permanent set was calculated from the following equation.

$$P=[(P1-P0)/P0]\times 100 \quad (3)$$

wherein:

P: coefficient (%) of permanent set of "S",

P1: thickness of "S" before test,

P0: thickness of "S" after test.

The results of the test are shown in the attached TABLE-4. As is seen from this table, the B, C and D-types of center holder part showed substantially smaller permanent set than the A-type.

(5) Load-Deflection test

Four types of cushion pads were produced which were:

A'-type: a cushion pad entirely constructed of only flexible foamed polyurethane, B'-type: a cushion pad including a major holder part constructed of flexible foamed polyurethane and a center holder part of the above-mentioned B-type, C'-type: a cushion pad including a major holder part constructed of flexible foamed polyurethane and a center holder part of the above-mentioned C-type, and D'-type: a cushion pad including a major holder part constructed of flexible foamed polyurethane and a center holder part of the above-mentioned D-type.

These four types (viz., A', B', C' and D'-types) of cushion pads were subjected to Load-Deflection test. In this test, each time the load applied to the cushion pad is increased or decreased, the deflection was plotted. The maxim load was 70 Kg.

The results of this test are shown in the graphs of FIGS. 3A, 3B, 3C and 3D. As is seen from these graphs, the B', C' and D'-types of cushion pad exhibited better Load-Deflection performance than the A'-type. This means that the cushion structure 4 of the invention is soft to the touch.

As is understood from the above, the cushion structure 4 of the first embodiment can provide the seat occupant with a comfortable sitting feeling.

Figure 4:
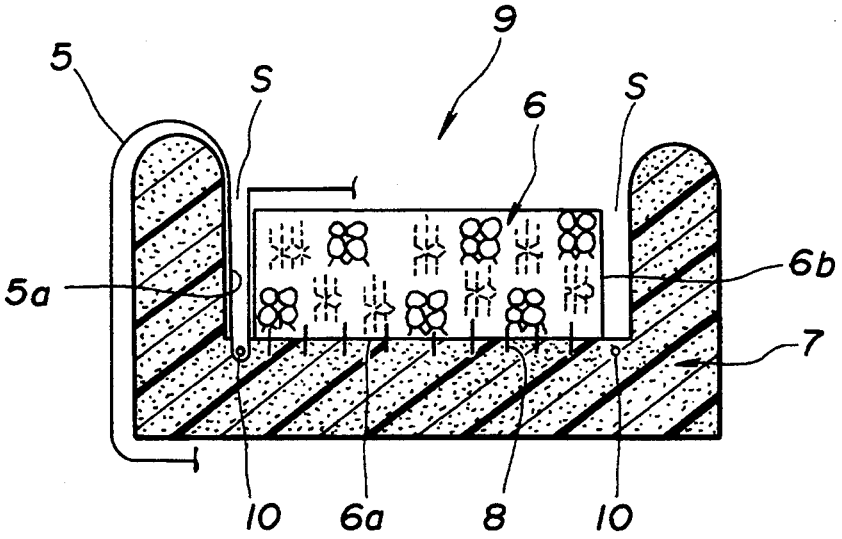
FIG. 4 is a view similar to FIG. 2, but showing a cushion structure of a second embodiment of the present invention.

Referring to FIG. 4 of the drawings, there is shown a cushion structure 9 of a second embodiment of the invention. The same parts as those of the above-mentioned first embodiment of FIG. 2 are denoted by the same numerals.

In this second embodiment, there are formed slits "s" between the major holder part 7 and the center holder part 6. As is understood from the drawing, in assembly, parts 5*a* of the outer skin 5 are drawn into the slits "s" and hooked to wires 10 installed in the major holder part 7, which brings about a good or sophisticated external appearance to the seat.

Due to provision of the slits "s", the flexibility of the center holder part 6 is increased. Furthermore, provision of such slits "s" can promote the air escaping which occurs when a person sits down on the seat, so that he or she can sit down without suffering undesired counterdamping action.

Figure 5:
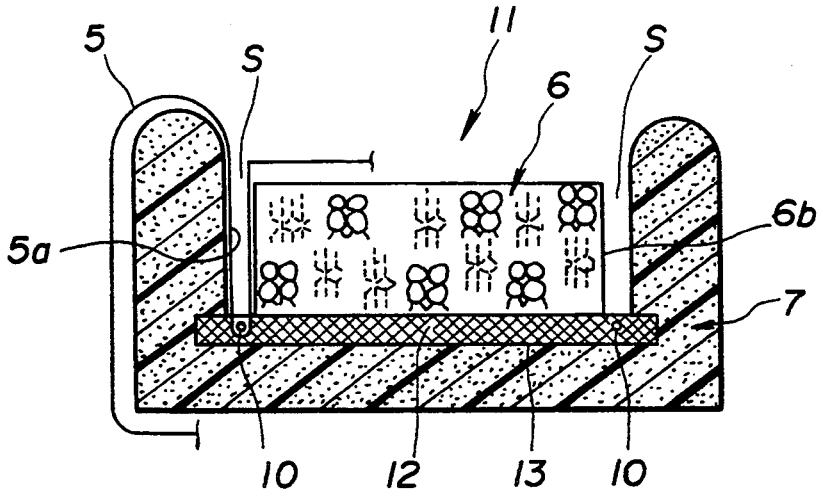
FIG. 5 is a view similar to FIG. 2, but showing a cushion structure of a third embodiment of the present invention.

Referring to FIG. 5, there is shown a cushion structure 11 of a third embodiment of the invention.

In this third embodiment, similar to the above-mentioned second embodiment, there are formed slits "s" into which the parts of the outer skin 5 are drawn. Furthermore, in this third embodiment, a polyurethane foam board 12 is attached to the bottom wall of the center holder part 6.

Due to provision of the board 12, a so-called "three layered construction" can be possessed by the center holder part 6, which improves the seat sitting feeling. Furthermore, since part of the urethane material penetrates into the flat plate 12 during its pouring into the molding die, a resiliently deformable part 13 is produced on a peripheral portion of the board 12 upon completion of curing of the material, which part 13 increases the cushioning effect of the center holder part 6.

Figure 6:
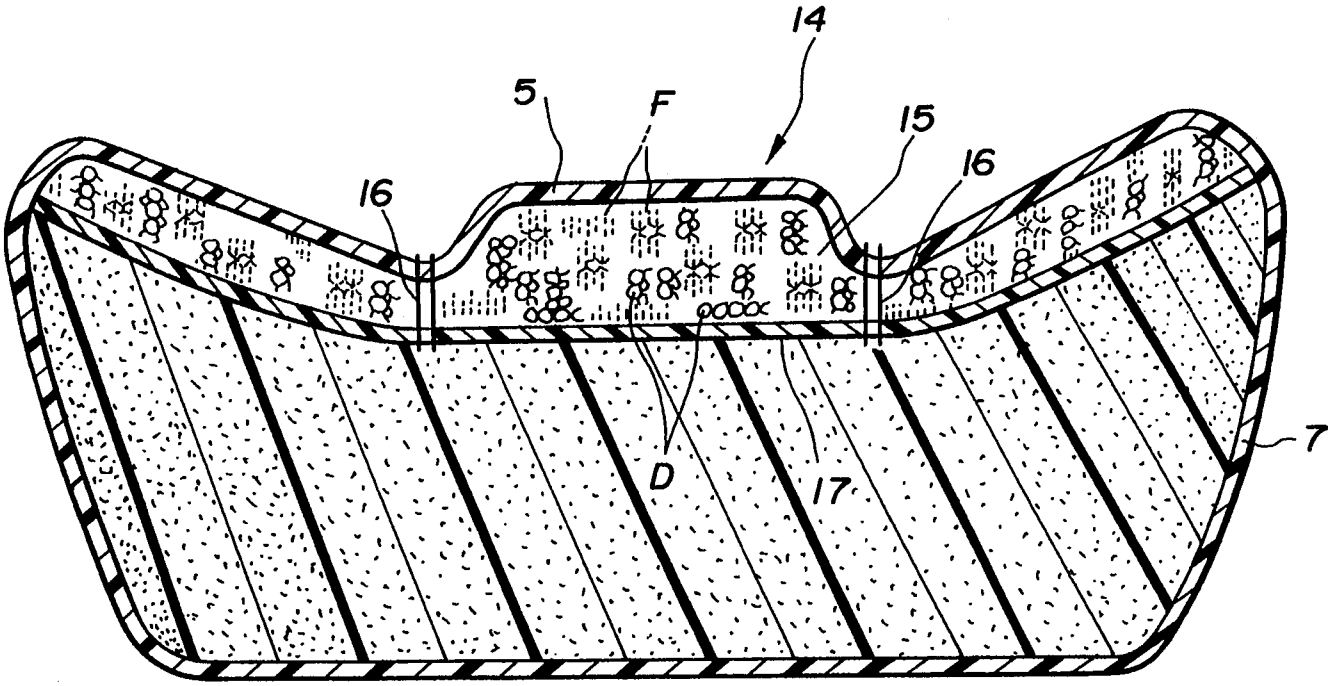
FIG. 6 is a schematically illustrated and enlarged sectional view taken along the line VI—VI of FIG. 1, showing a cushion structure of a fourth embodiment of the present invention.
Figures 7A, 7B, 7C, 7D:
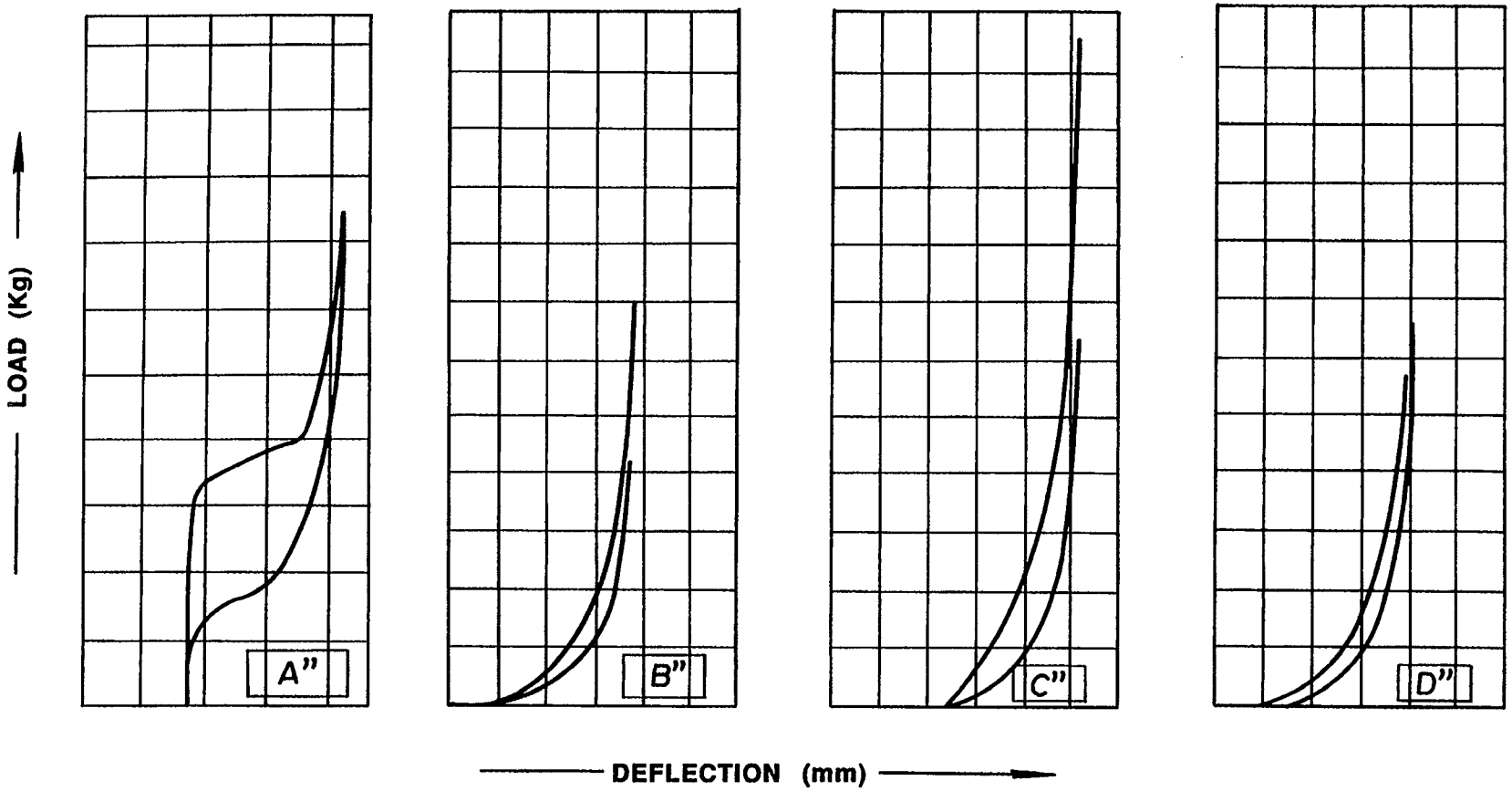
FIGS. 7A, 7B, 7C and 7D are graphs showing the "Load-Deflection" characteristic of four types of materials for the cushion structure of the fourth embodiment.

Referring to FIG. 6, there is shown a cushion structure 14 which is a fourth embodiment of the present invention. The cushion structure 14 of this fourth embodiment is applied to the seat-back portion 3 of the seat 1.

As is seen from the drawing, the cushion structure 14 comprises generally a major holder part 7 constructed of foamed polyurethane, a so-called "front cover" 15 constructed of the wadding of bound down and feather, and a bag-shaped outer skin 5 constructed of an artificial leather or the like. The wadding of the front cover 15 comprises about 90 wt % down "D" and 10 wt % feather "F".

As is seen from this drawing, the front cover 15 is arranged to entirely cover a front surface of the major holder part 7. The front cover 15 and the major holder part 7 constitute a cushion pad. The cushion pad is received in the bag-shaped outer skin 5. The front cover 15 has two stitched portions 16 by which the front cover 15 is partitioned into three portions. Designated by numeral 17 is a back covering film which is stitched to the back surface of the front cover 15.

The process of producing the cushion structure 14 is as follows.

First, a wad including about 90 wt % down and about 10 wt % feather is prepared, and uncured and thus liquefied material of polyurethane elastomer as a binder is sprayed upon the wad while stirring the wad. The wad is then put into a shaping case and led into an oven to cure the binder. With this, a substantially flat shaped wadding of the bound down and feature is produced. Then, the back covering film 17 is stitched to the back surface of the shaped wadding and stitching is applied to the two portions of the wadding to partition the same into three portions. Then, the wadding is placed in a molding die and a liquid material for foamed polyurethane is poured into the molding die. The molding die is then led into an oven to cure the polyurethane foam. With this, a cushion pad including the major holding part 17 and the substantially flat front cover 15 of the shaped wadding is produced. Then, the cushion pad thus produced is put into the bag-shaped outer skin 5 to produce the cushion structure 14.

The front cover 15, more specifically, the shaped wadding of the same has such performances as described in the first embodiment.

In order to examine the touch feeling of the front cover 15, the following Load-Deflection test was carried out.

For this test, four types of front covers were produced which are:

A''-type: a front cover constructed of only flexible foamed polyurethane.,

B''-type: a front cover constructed of 30 wt.% down and 70 wt % feather,

C''-type: a front cover constructed of 50 wt.% down and 50 wt % feather, and

D''-type: a front cover constructed of 90 wt. % down and 10 wt % feather.

These four types (viz., A'', B'', C'' and D''-types) of front covers were subjected to Load-Deflection test. In this test, each time the deflection indicated a given value due to increase or reduction of load applied to the front cover, the load was plotted. The maximum deflection was 75%.

The results of this test are shown in the graphs of FIGS. 7A, 7B, 7C and 7D. As is seen from these graphs, the B'', C'' and D''-types of cushion pad exhibited better Load-Deflection performance than the A''-type. This means that the front cover 15 of the invention is soft to the touch.

Figure 8:
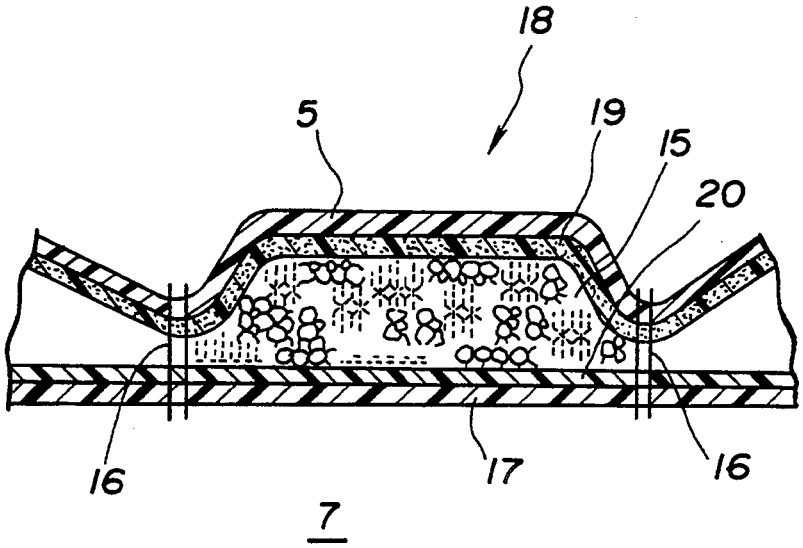
FIG. 8 is a view similar to FIG. 6, but showing a cushion structure of a fifth embodiment of the present invention.

Referring to FIG. 8, there is shown a cushion structure 18 of a fifth embodiment of the present invention. The same parts as those of the above-mentioned fourth embodiment of FIG. 6 are denoted by the same numerals.

In this fifth embodiment, a foamed polyurethane layer 19 is intimately interposed between the outer skin 5 and the front surface of the front cover 15 of the wadding, and a resilient plate 20 is intimately interposed between the bottom surface of the front cover 15 and the back covering film 17, as shown.

Due to provision of the resilient plate 20, excessive depression of the cushion structure 18 is suppressed even when a heavy person sits down on the seat. The provision of the polyurethane foam layer 19 improves the cushion performance of the front cover 15. Furthermore, the provision of the polyurethane foam layer 19 promotes the outer skin 5 in having a smoothed outer surface. If desired, felt layer, woven fabric, non woven fabric or the like may be used in place of the polyurethane foam layer 19.

Figure 9:
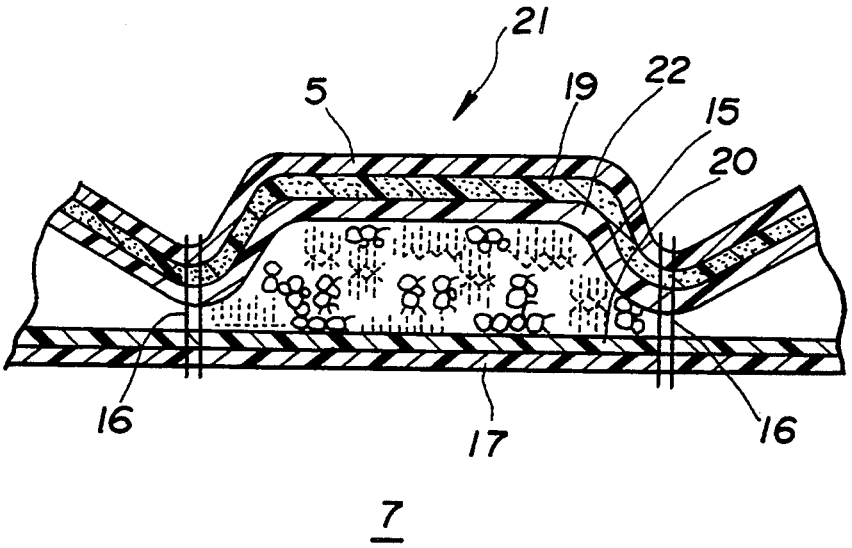
FIG. 9 is a view similar to FIG. 6, but showing a cushion structure of a sixth embodiment of the present invention.

Referring to FIG. 9, there is shown a cushion structure 21 of a sixth embodiment of the present invention.

In this sixth embodiment, a flexible sheet member 22 is further used in the construction of the fifth embodiment. The flexible sheet member 22 is intimately interposed between the front cover 15 of the wadding and the foamed polyurethane layer 19.

Due to provision of the flexible sheet member 22, the smoothing of the outer skin 5 is much assured.

TABLE 1

| TYPE | TIME (min.) 3 | 30 | 60 | 120 |
|---|---|---|---|---|
| A | 0 | 0 | 0 | 0 |
| B | 0.18 | 1.9 | 2.8 | 3.7 |
| C | 0.15 | 2.0 | 2.7 | 4.2 |
| D | 1.0 | 4.1 | 6.2 | 8.0 |

(%)

TABLE 2

| TYPE | TIME (min.) 20 | 40 | 60 | 90 | 120 | 150 |
|---|---|---|---|---|---|---|
| A | 30.0 | 52.4 | 63.1 | 70.3 | 80.2 | 86.5 |
| B | 38.2 | 65.2 | 82.6 | 89.5 | 96.1 | 99.3 |
| C | 46.8 | 82.5 | 93.9 | 97.4 | 99.3 | 99.8 |
| D | 58.0 | 80.1 | 88.1 | 91.2 | 96.2 | 98.5 |

(%)

TABLE 3

| TYPE | | TIME (min.) 0 | 1 | 2 | 3 | 5 | 10 | 15 | 20 | 30 | 60 |
|---|---|---|---|---|---|---|---|---|---|---|---|
| A | CENTER | 50 | 35 | 31 | 29 | 28 | 27 | | | | |
| | OUTER | 58 | 45 | 37 | 33 | 28 | 27 | | | | |
| B | CENTER | 60 | 64 | 58 | 51 | 41 | 33 | 31 | 27 | | |
| | OUTER | 59 | 43 | 37 | 35 | 32 | 30 | 29 | 28 | | |
| C | CENTER | 50 | 57 | 54 | 44 | 38 | 34 | 31 | 27 | | |
| | OUTER | 56 | 42 | 37 | 34 | 30 | 29 | 28 | 27 | | |
| D | CENTER | 59 | 67 | 62 | 53 | 41 | 35 | 33 | 31 | 30 | 27 |
| | OUTER | 52 | 37 | 35 | 33 | 30 | 29 | 28 | 27 | 26 | 25 |

(°C.)

TABLE 4

| TYPE | DRY | WET |
|---|---|---|
| A | 8.0 | 10.0 |
| B | 4.5 | 3.5 |
| C | 12.5 | 7.0 |
| D | 3.3 | 6.6 |

(%)

What is claimed is:

1. An automotive seat including a seat base portion and a seat back portion, said seat base portion having a cushion structure which comprises:

a major holder part constructed of foamed polyurethane, said major holder part having a recess at a center portion thereof;

a center holder part constructed of a wadding which includes down and feathers bound together with a binder of polyurethane elastomer, which is cured after being added to and mixed with the down and feathers, said center holder part being snugly received in said recess of said major holder part, said wadding including approximately 30 to 90 weight percent down and approximately 70 to 10 weight percent feathers; and a bag-shaped outer skin covering both said major holder part and said center holder part.

2. An automotive seat as claimed in claim 1, wherein said wadding comprises approximately 90 weight percent down and approximately 10 weight percent feathers.

3. An automotive seat as claimed in claim 2, wherein a part of the polyurethane foam of said major holding part penetrates the wadding of said center holder part to provide secure bonding therebetween.

4. An automotive seat as claimed in claim 1, wherein said major holder part and said center holder part define therebetween a slit into which a part of said bag-shaped outer skin is drawn and hooked to a bottom portion of said slit.

5. An automotive seat as claimed in claim 4, wherein a part of the polyurethane foam of said major part penetrates the wadding of said center holder part to provide an assured bonding therebetween.

6. An automotive seat as claimed in claim 4, wherein a polyurethane foam board is interposed between a bottom wall of said center part and the bottom portion of said slit, so that said cushion structure has a three-layered construction.

7. An automotive seat as claimed in claim 1, wherein said seat back portion has a cushion structure which comprises:

a major holder part constructed of foamed polyurethane;

a front cover constructed of a wadding which includes down and feathers bound together with a binder of polyurethane elastomer, said front cover entirely covering a front surface of said major holder part, said wadding including approximately 90 weight percent down and approximately 10 weight percent feathers; and a bag-shaped outer skin covering both said major holder and said front cover.

8. An automotive seat as claimed in claim 7, wherein said wadding is produced by:

(a) preparing a wad of down and feathers;

(b) spraying a liquid binder upon said wad while stirring the same, said liquid binder comprising a liquified polyurethane elastomer;

(c) putting said wad into a shaping mold; and (d) heating said wad to cure said binder thereby producing a resiliently deformable shaped wadding.

9. An automotive seat as claimed in claim 7, further comprising:

two stitched portions by which said front cover is partitioned into three portions; and a back covering film which is stitched to a back surface of said front cover.

10. An automotive seat as claimed in claim 9, further comprising:

a foamed polyurethane layer intimately interposed between said bag-shaped outer skin and the front surface of said front cover; and a resilient plate intimately interposed between the bottom wall of said front cover and said back covering film.

11. An automotive seat as claimed in claim 10, further comprising:

a flexible sheet member intimately interposed between said front cover and said foamed polyurethane layer.

12. An automotive seat as claimed in claim 1, wherein said wadding is produced by:

(a) preparing a wad of down and feathers;

(b) spraying a liquid binder upon said wad while stirring the same, said liquid binder comprising a liquified polyurethane elastomer;

(c) putting said wad into a shaping mold; and (d) heating said wad to cause said binder to cure thereby producing a resiliently deformable shaped wadding.

13. An automotive seat comprising:

a seat base portion having a cushion structure which includes:

a major holder part constructed of foamed polyurethane, said major holder part having a recess at a center portion thereof; and a center holder part constructed of a wadding which includes down and feathers bound together with a binder of polyurethane elastomer, said center holder part being snugly received in said recess of said major holder part, said wadding including approximately 90 weight percent down and approximately 10 weight percent feathers; and a seat back portion having a cushion structure which includes:

a major holder part constructed of foamed polyurethane;

a front cover constructed of a wadding which includes down and feathers bound with a binder of polyurethane elastomer, said front cover entirely covering a front surface of said major holder part, said wadding including approximately 90 weight percent down and approximately 10 weight percent feathers; and a bag-shaped outer skin covering both said major holder and said front cover, wherein a part of the polyurethane foam of the major holder part of said seat base portion penetrates the wadding of said center holder part of said seat base portion.

* * * * *